US009999299B2

(12) United States Patent
Neuwirth et al.

(10) Patent No.: US 9,999,299 B2
(45) Date of Patent: Jun. 19, 2018

(54) STORAGE SYSTEM WITH RETRACTABLE CELLS

(71) Applicant: Unex Manufacturing, Inc., Lakewood, NJ (US)

(72) Inventors: Mark F. Neuwirth, Manasquan, NJ (US); David J. Burke, Brick, NJ (US)

(73) Assignee: UNEX MANUFACTURING, INC., Lakewood, NJ (US)

( * ) Notice: Subject to any disclaimer, the term of this patent is extended or adjusted under 35 U.S.C. 154(b) by 4 days.

(21) Appl. No.: 15/251,945

(22) Filed: Aug. 30, 2016

(65) Prior Publication Data

US 2017/0055699 A1 Mar. 2, 2017

Related U.S. Application Data

(60) Provisional application No. 62/212,295, filed on Aug. 31, 2015.

(51) Int. Cl.

| | |
|---|---|
| ***A47B 43/00*** | (2006.01) |
| ***A47B 61/00*** | (2006.01) |
| ***A47F 5/08*** | (2006.01) |
| ***A47B 43/04*** | (2006.01) |

(52) U.S. Cl.

CPC ..... *A47B 43/006* (2013.01); *A47B 43/00* (2013.01); *A47B 43/003* (2013.01); *A47B 43/04* (2013.01); *A47B 61/003* (2013.01); *A47F 5/08* (2013.01); *A47F 5/0892* (2013.01)

(58) Field of Classification Search

CPC . A47B 43/006; A47B 2051/005; A47B 47/00; A47B 51/00; A47B 43/003; A47B 61/003; A47B 57/20; A47B 5/08; A47B 57/406; A47B 43/04; A47B 73/006; A47B 61/04; A47B 61/06; A47B 47/06; A47B 43/00; A47B 61/00; A47F 5/08; A47F 5/0892; A47F 7/08; A47F 5/0006; A47F 5/0081; A45C 7/0077; A45C 3/12; A45C 13/03; A47G 25/005; B07C 7/02

USPC ..... 312/3–6; 206/286, 287.1; 211/118, 85.3, 211/186, 113, 117, 195, 90.01, 34–38, 211/103, 72, 135

See application file for complete search history.

(56) References Cited

U.S. PATENT DOCUMENTS 1,225,607 A * 5/1917 Heeter ..... A47B 43/006 108/149

1,602,771 A * 10/1926 Mitchell ..... A47B 51/00 108/164

(Continued)

*Primary Examiner* — Hiwot E Tefera

(74) *Attorney, Agent, or Firm* — Hoffmann & Baron, LLP

(57) ABSTRACT

A storage system has retractable cells used for with storing and transporting articles in totes. A plurality of spaced apart shelves extends transversely between left and right flexible vertical panels. Left and right hangers extend upward from a distal end attached to a shelf to a proximal end at a structural support. A plurality of guide members are attached to the vertical panels, juxtaposed with the shelves. Each guide member slidingly engages a hanger. Means is provided for pulling the left and right hangers upward to raise the shelves upward. The hangers can be secured either to the support or to a shelf above. The left and right panels will fold inwardly between the shelves. The space beneath the shelves will increase to receive an article larger than a tote.

15 Claims, 14 Drawing Sheets

(56) References Cited

U.S. PATENT DOCUMENTS

| | | | | | |
|---|---|---|---|---|---|
| 1,640,083 | A * | 8/1927 | Ladd | B07C 7/02 | 211/186 |
| 3,519,318 | A * | 7/1970 | Hagen | A47B 43/04 | 312/213 |
| 3,904,258 | A * | 9/1975 | Faulkenberry | A47B 43/04 | 108/164 |
| 4,329,789 | A * | 5/1982 | Erickson | F26B 25/18 | 108/164 |
| 7,063,397 | B2 * | 6/2006 | Sabounjian | A47B 43/003 | 206/287.1 |
| 7,258,232 | B2 * | 8/2007 | Bradford | B65D 19/18 | 206/386 |
| 9,259,082 | B2 * | 2/2016 | Barre | A47B 43/003 | |
| 9,669,907 | B2 * | 6/2017 | Field | B63B 35/7946 | |
| 2007/0131683 | A1 * | 6/2007 | Sabounjian | A45C 7/0077 | 220/9.1 |
| 2010/0276241 | A1 * | 11/2010 | Malone | A45C 5/03 | 190/9 |
| 2011/0042335 | A1 * | 2/2011 | McNicholas | A47B 43/003 | 211/85.3 |

* cited by examiner

STORAGE SYSTEM WITH RETRACTABLE CELLS

CROSS REFERENCE TO RELATED APPLICATIONS

This application claims priority to U.S. Provisional Patent Application No. 62/212,295, filed on Aug. 31, 2015, the contents of which are incorporated herein by reference in its entirety.

TECHNICAL FIELD

The present invention is directed to an apparatus and method for storing articles in cells and more particularly to a system wherein the cells are selectively variable in size.

BACKGROUND

In article handling and storing systems, an array of cells is often employed for temporary holding of articles in a warehouse environment. This occurs in the distribution process between manufacturing and retail sales. Articles enter the warehouse and are placed in cells having a known location identifier, such as x columns across and y rows down in the array. The cells are typically of uniform width, height, and depth. The cell array is often constructed of a plastic such as vinyl in sheet form, or of a fabric. The cell array structure is sewn together. Alternatively, the structure can be assembled by heat-sealing or with adhesives. The sheet or fabric structure is lightweight and inexpensive.

The cell array structure has a flexible vertical panel on each side, left and right. The front and rear aspects are open. A plurality of shelves extends across between the vertical panels. The shelves are spaced apart vertically. Each shelf has a double floor sewn together, forming a pocket. A rigid plate is inserted into the pocket, which is then sewn closed. The plate can be any lightweight, inexpensive material, such as vinyl, PVC, ABS, Masonite, plywood, etc. The plate serves to stiffen and strengthen the shelves to hold the articles.

The cell array is top-supported, and hangs downward from a structural support or frame. Several cell arrays can be arranged one behind another, two or three deep. The cell array can be stationary, or can be hung on rollers to slide left and right so as to allow access to a second or third array hanging behind the first array. Handcarts are used to convey articles from one area to another. Incoming products arrive and are sent to the cell array storage area by cart. Later, outgoing orders are taken by cart to shipping.

The articles are typically placed in totes, or trays of a predetermined size designed to fit into the cells. The totes are then placed into the cells. In this embodiment, the user is handling totes approximately 80% of the time. Articles do not always fit within the totes. Articles that are too large must be placed upon the floor, or in a special area. These exceptions occur approximately 20% of the time. Examples are bags of dog food or large items in boxes. Large articles are often placed upon the top of the cart. A heavy article is difficult to lift, may cause injury, and makes the cart top-heavy.

Accordingly, it would be desirable to provide a storage cell array system capable of accommodating both totes and articles of varying sizes, including bulky, heavy, and large articles, thereby avoiding the problems associated with the prior art.

SUMMARY

In one aspect, a storage system with retractable cells is used in connection with storing and transporting articles. The storage system comprises a structural support. A cell array includes a left flexible vertical panel depending from the structural support. A right flexible vertical panel also depends from the structural support. The right vertical panel is generally parallel to the left vertical panel and spaced apart therefrom. A plurality of shelves extends transversely between the left vertical panel and the right vertical panel. The shelves are generally rigid. The shelves are spaced apart vertically by a predetermined space.

A left filament extends from a proximal end at the structural support to a distal end attached to a one of the plurality of shelves. A right filament extends from a proximal end at the structural support to a distal end attached to a one of the plurality of shelves. A plurality of left guide members are attached to the left vertical panel. Each left guide member is juxtaposed with one of the plurality of shelves. Each left guide member slidingly engages the left filament. A plurality of right guide members is attached to the right vertical panel. Each right guide member is juxtaposed with one of the plurality of shelves. Each right guide member slidingly engages the right filament.

Pulling means is provided for pulling the left filament and right filament upward. This is to raise the plurality of shelves upward. The left vertical panel and the right vertical panel will fold inwardly between the shelves in the manner of an accordion bellows. Thus, the space beneath the shelves will increase. The result is to receive an article beneath the shelves larger than the predetermined space.

In another aspect, a method is disclosed for retracting cells. This is used in a storage system for storing and transporting articles. The method comprises providing a structural support. Left and right flexible vertical panels are depending from the structural support. The vertical panels are spaced apart. A plurality of shelves extends transversely between the vertical panels. Spacing the shelves apart vertically by a predetermined space allows sufficient space to receive one of the articles.

Left and right filaments are extending from proximal ends at said structural support to distal ends. The distal ends attach to one of the plurality of shelves. The left and right filaments are for pulling upward.

In practice, the plurality of shelves will be raised upward by pulling the left and right filaments. This will increase space beneath the shelves by raising the shelves upward. The resulting space will thereby allow an article larger than the predetermined space to be received beneath the shelves.

In still another aspect, a storage system with retractable cells for storing and transporting articles is for use in connection with a structural support. The storage system comprises left and right flexible vertical panels. The panels are adapted for depending from the structural support. A plurality of shelves extends transversely between the left and right vertical panels. The plurality of shelves includes a lowermost shelf. The shelves are spaced apart vertically by a predetermined space.

Left and right filaments are each attached at a distal end to the lowermost shelf. The filaments extend upward to a proximal end adapted for attachment to one of the plurality of shelves above the lowermost shelf. Attachment means is provided for attaching the left and right filaments to one of the plurality of shelves.

In practice, the lowermost shelf will be lifted manually upward, to selectively raise at least one of the plurality of shelves upward. The left and right filaments will be attached to one of the shelves above the lowermost shelf with the attachment means. This is for increasing the space beneath the plurality of shelves so as to receive, below the lowermost shelf, an article larger than the predetermined space.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
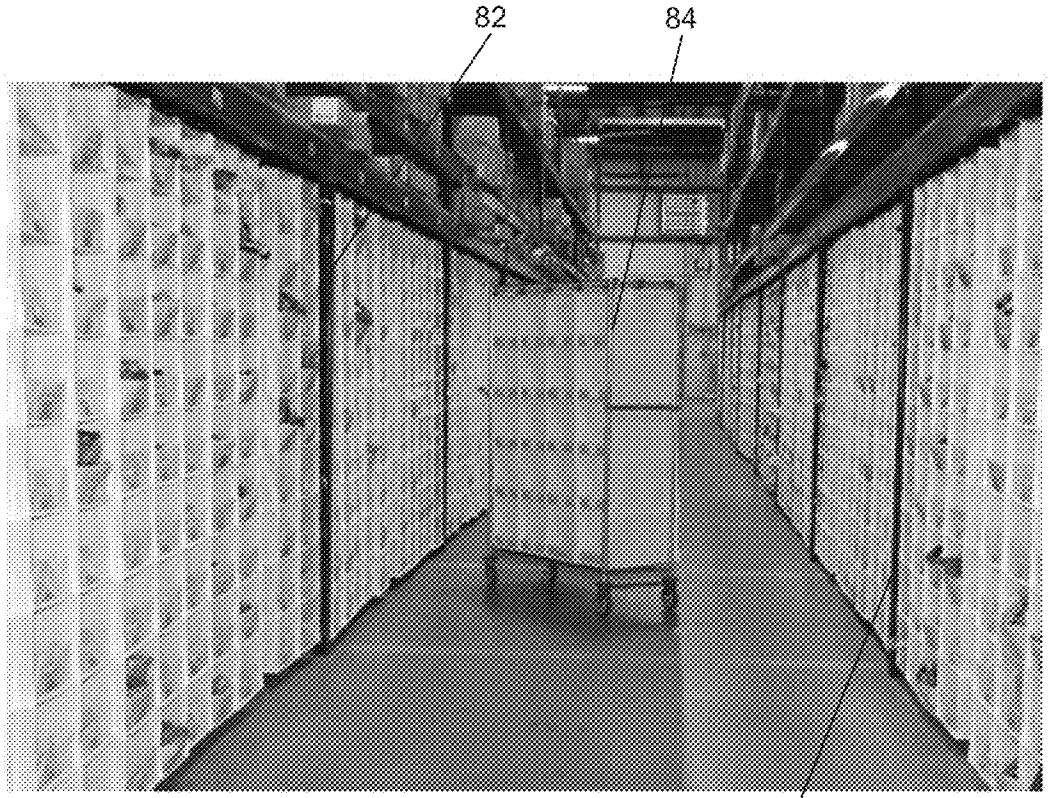
PRIOR ART FIG. 1
FIG. 1 is a side elevational view of a prior art storage system with cells that could make use of the disclosed invention.
Figure 2:
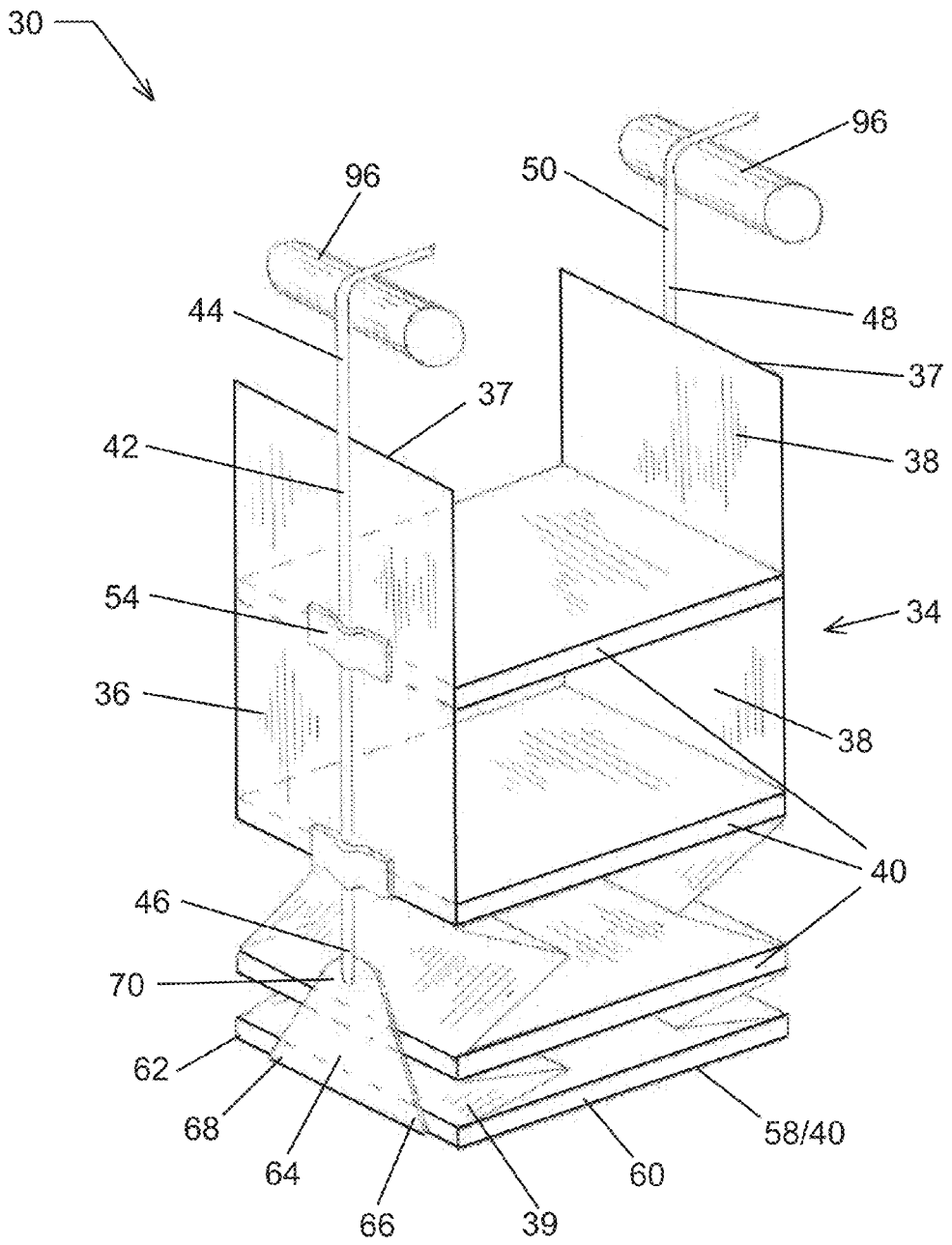
FIG. 2 is a perspective view of a storage system of the present invention with retractable cells constructed in accordance with the invention.
Figure 3:
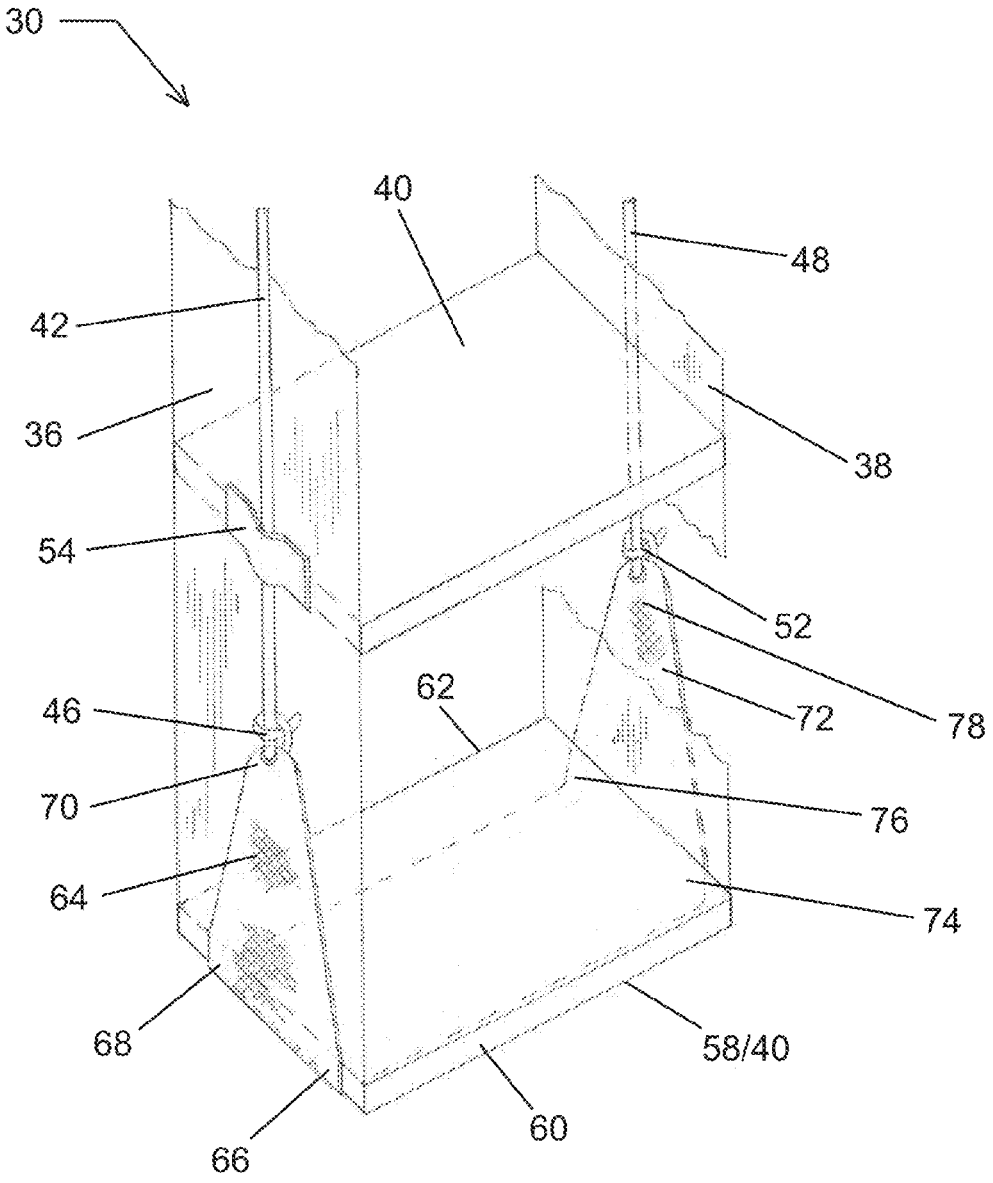
FIG. 3 is a detail perspective view of the storage system with retractable cells of FIG. 2, and showing an embodiment of a sling.
Figure 4:
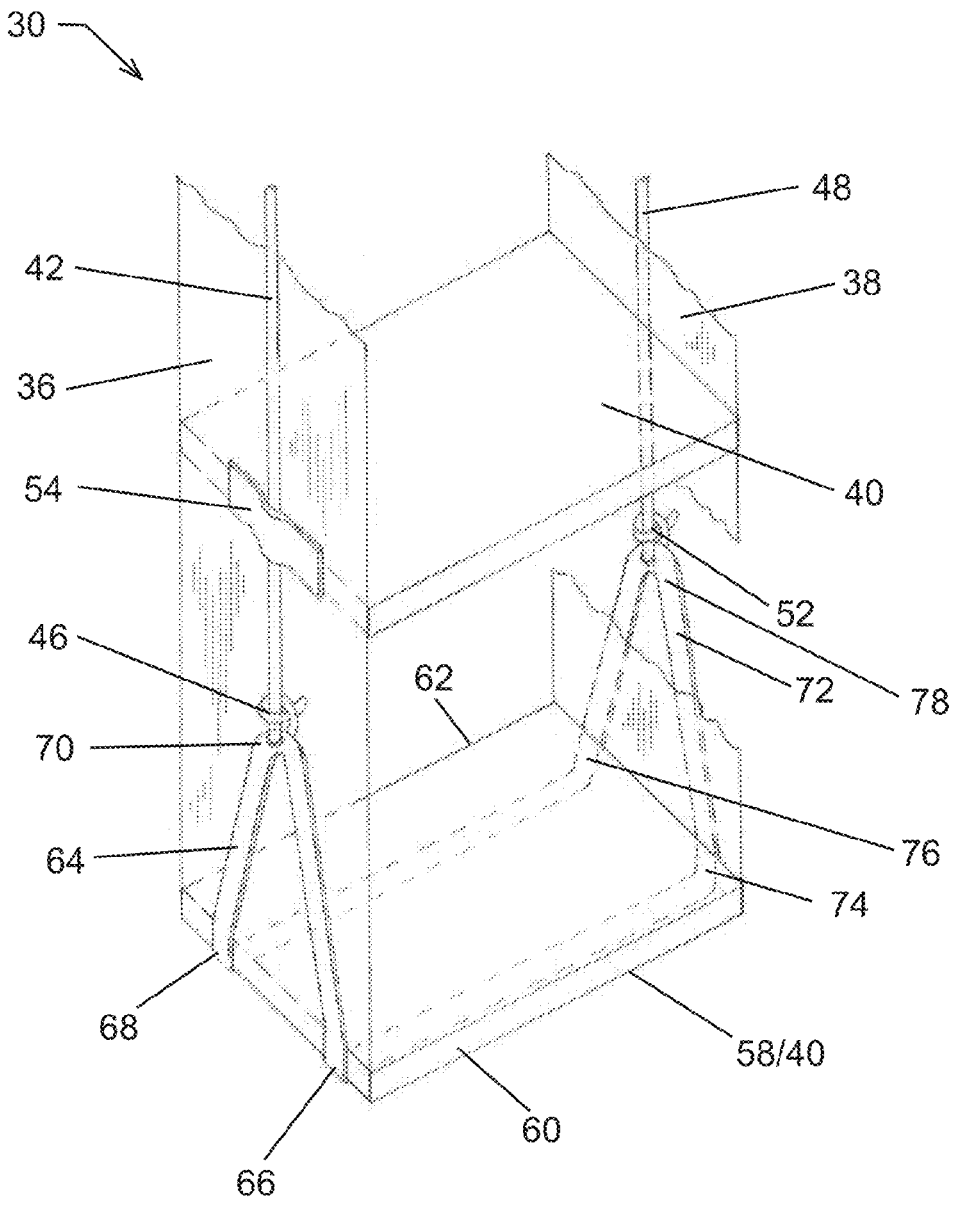
FIG. 4 is a perspective view of the storage system of with retractable cells of FIG. 2, showing another embodiment of a sling.

Describing now in further detail these exemplary embodiments with reference to the Figures as described above, it should be noted that the drawings presented herein are not to scale. A storage system with retractable cells 30 is used in connection with storing and transporting articles. The storage system 30 comprises a structural support 32. A cell array 34 is a single hanging column of cells, and includes a left flexible vertical panel 36 depending from the structural support 32. A suspending member 35 non-limitingly attaches the cell array 34 to the structural support 32. A right flexible vertical panel 38 also depends from the structural support 32. The left and right flexible vertical panels 36, 38 are attached at an upper end 37 to the structural support 32. The right vertical panel 38 is generally parallel to the left vertical panel 36 and spaced apart therefrom. A plurality of shelves 40 extends transversely between the left vertical panel 36 and the right vertical panel 38. The shelves 40 are generally rigid. The shelves 40 are spaced apart vertically by a predetermined space. The plurality of shelves 40 includes a lowermost shelf 58 having a front edge 60 and a rear edge 62. The left and right flexible vertical panels 36, 38 are attached at a lower end 39 to the lowermost shelf 58.

Figure 6:
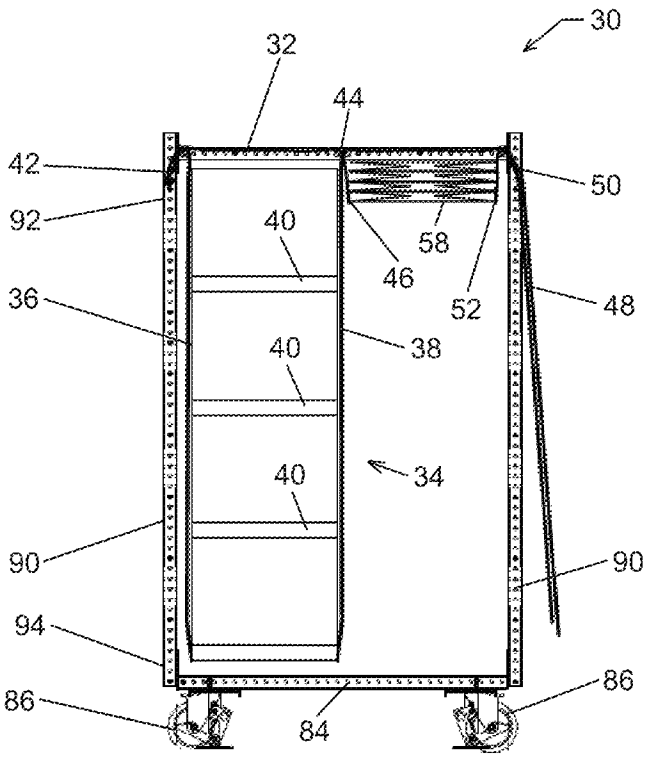
FIG. 6 is a front elevational view of the storage system with retractable cells of FIG. 2, and showing two cell arrays mounted in a mobile support.
Figure 5:
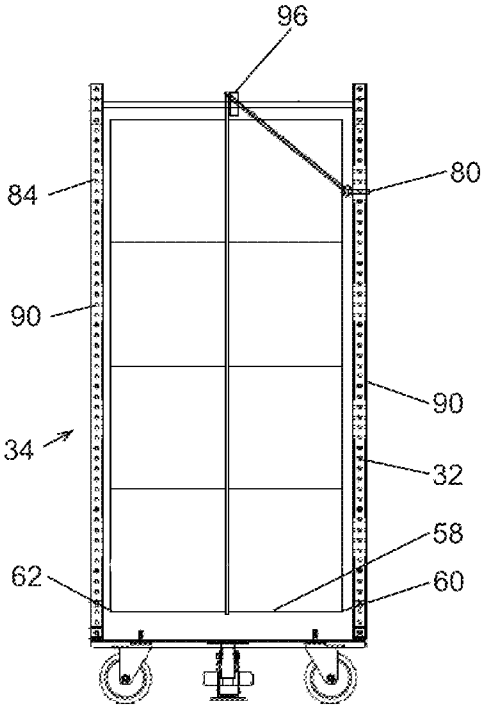
FIG. 5 is a side elevational view of the storage system with retractable cells of FIG. 2, and showing two cell arrays mounted in a mobile support.
Figure 9:
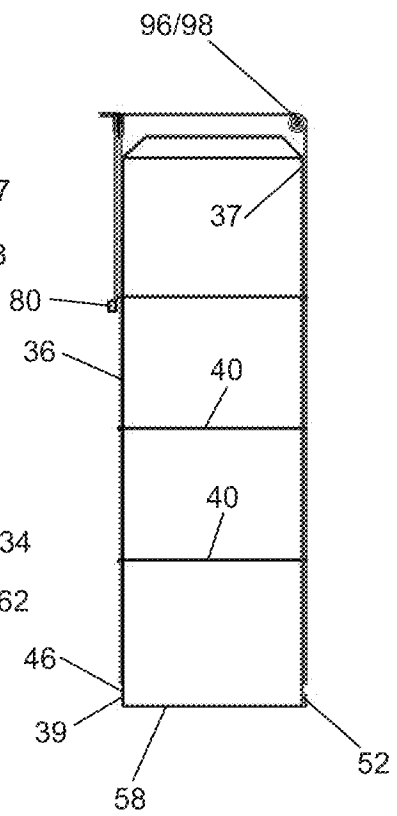
FIG. 9 is a front elevational view of the storage system with retractable cells of FIG. 2, and showing one cell array with pulleys.
Figure 7:
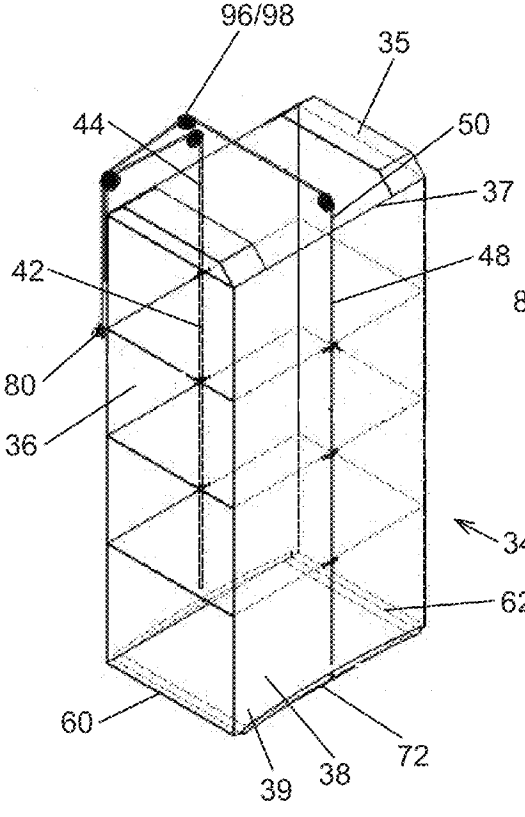
FIG. 7 is a perspective view of the storage system with retractable cells of FIG. 2, and showing one cell array with pulleys.
Figure 8:
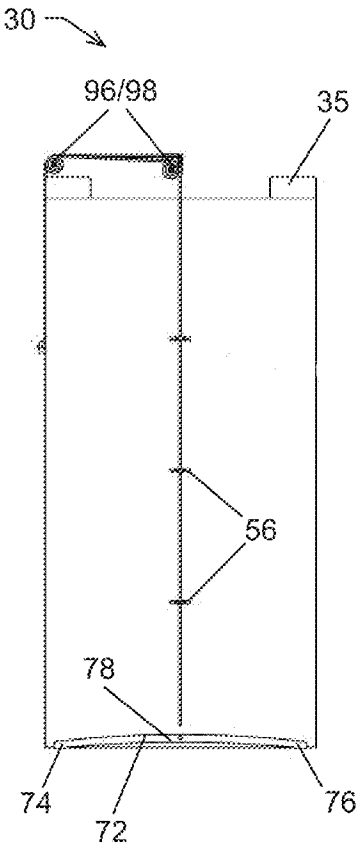
FIG. 8 is a side elevational view of the storage system with retractable cells of FIG. 2, and showing one cell array with pulleys.
Figure 12:
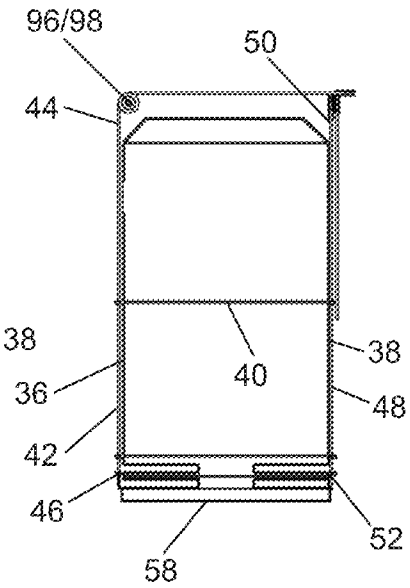
FIG. 12 is a front elevational view of the storage system with retractable cells of FIG. 2, showing the cells partly retracted.
Figure 10:
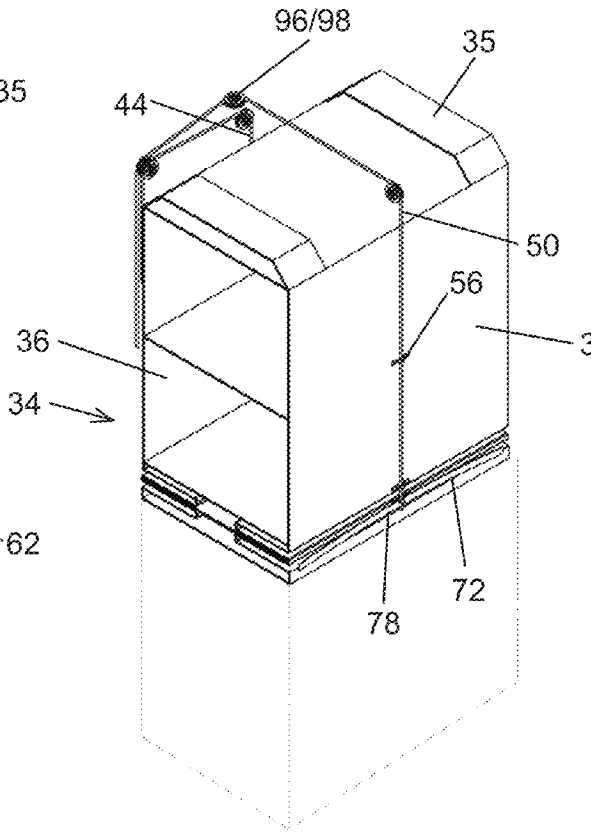
FIG. 10 is a perspective view of the storage system with retractable cells of FIG. 2, showing the cells partly retracted.
Figure 11:
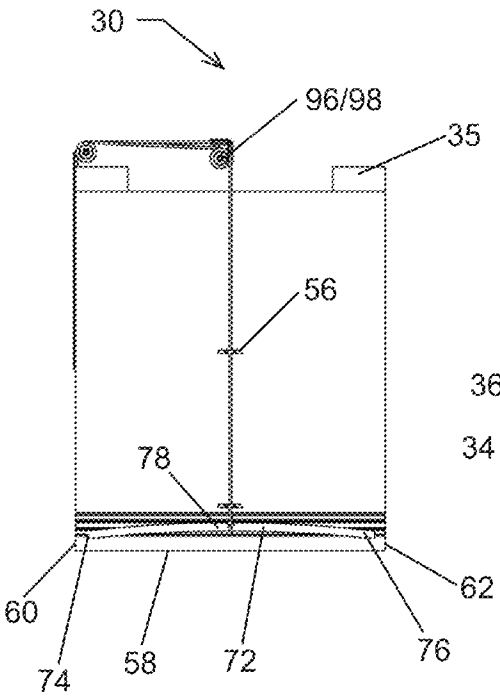
FIG. 11 is a side elevational view of the storage system with retractable cells of FIG. 2, showing the cells partly retracted.

The structural support 32 includes upright columns 90 extending between opposite upper 92 and lower 94 ends. The structural support 32 can be a stationary framework or fixed support 82, as shown in FIG. 1. The structural support 32 can be a cart or mobile support 84 having wheels 86, as shown in FIGS. 5 and 6. In the desirable embodiment shown, the structural support 32 has two cell arrays 34 hanging side by side. This arrangement is non-limiting, and it is to be understood that any number of cell arrays 34 can be mounted in the structural support 32.

The cell array 34 is raised, lowered, and secured by right and left hangers, each hanger being attached at a distal end to the respective right and left panel lower end. As used herein, a "hanger" means any structure or means for raising, lowering, and/or securing the cell array of the storage system of the present invention. Non-limiting examples of hangers useful in the present invention are described below and include, without limitation, one or more filaments, one or more slings with our without attached filament(s), and wireformed clips used in conjunction with engaging members. In an embodiment, the one or more filaments may be secured using an attachment meand such as a hook and loop fastener.

In an embodiment, each hanger includes a filament. A left filament 42 extends from a proximal end 44 at the structural support 32 to a distal end 46 attached to a one of the plurality of shelves 40. A right filament 48 extends from a proximal end 50 at the structural support 32 to a distal end 52 attached to one of the plurality of shelves 40.

A plurality of left engaging members, or guide members 54 are attached to the left vertical panel 36. Each left guide member 54 is juxtaposed with one of the plurality of shelves 40. Each left guide member 54 slidingly engages the left hanger or filament 42. A plurality of right engaging members, or guide members 56 is attached to the right vertical panel 38. Each right guide member 56 is juxtaposed with one of the plurality of shelves 40. Each right guide member 56 slidingly engages the right hanger or filament 48. The left and right guide members are typically webbing sewn or attached to the left and right vertical panels 36, 38, respectively. However, any material can be used.

In an embodiment of the present invention, a left sling 64 has a front portion 66 attached to the lowermost shelf 58 adjacent the front edge 60 and a rear portion 68 attached to the lowermost shelf 58 adjacent the rear edge 62. The front 66 and rear 68 portions extend upward from the lowermost shelf 58 and converge at a left sling apex 70. The left filament distal end 46 is attached to the left sling apex 70. A right sling 72 has a front portion 74 attached to the lowermost shelf 58 adjacent the front edge 60 and a rear portion 76 attached to the lowermost shelf 58 adjacent the rear edge 62. The front 74 and rear 76 portions extend upward from the lowermost shelf 58 and converge at a right sling apex 78. The right filament distal end 52 is attached to the right sling apex 78. Thus, the front and rear portions of the left 64 and right 72 slings, being spaced apart, will stabilize the lowermost shelf against tipping.

A pulling means is provided for pulling the left filament 42 and right filament 48 upward. This is to raise the plurality of shelves 40 upward. The pulling means comprises an arcuate turning member 96 at the upper end 92 of the structural support 32. The left filament proximal end 44 extends over the arcuate turning member 96. The right filament proximal end 50 also extends over the arcuate turning member 96. The arcuate turning member 96 can comprises a system of pulleys 98, as shown in FIGS. 7-14. The left filament 42 and right filament 48 typically are ropes, but can be any element capable of transmitting tension in pulling. The ropes are passed over the pulleys 98 and down to a cleat 80 on the upright columns 90. The arcuate turning member 96 can comprise a winch (not shown) adapted for motor driving. The pulling means will typically comprise manually pulling on the filament proximal ends 44, 50. The left filament 42 proximal end 44 and the right filament 48 proximal end 50 each extend beyond the arcuate turning member 96. Securing means is provided for securing the shelves in the raised position with the hangers. The filaments 42, 48 can be secured by a cleat 80 or other means well known by those skilled in the art.

Figures 13, 14:
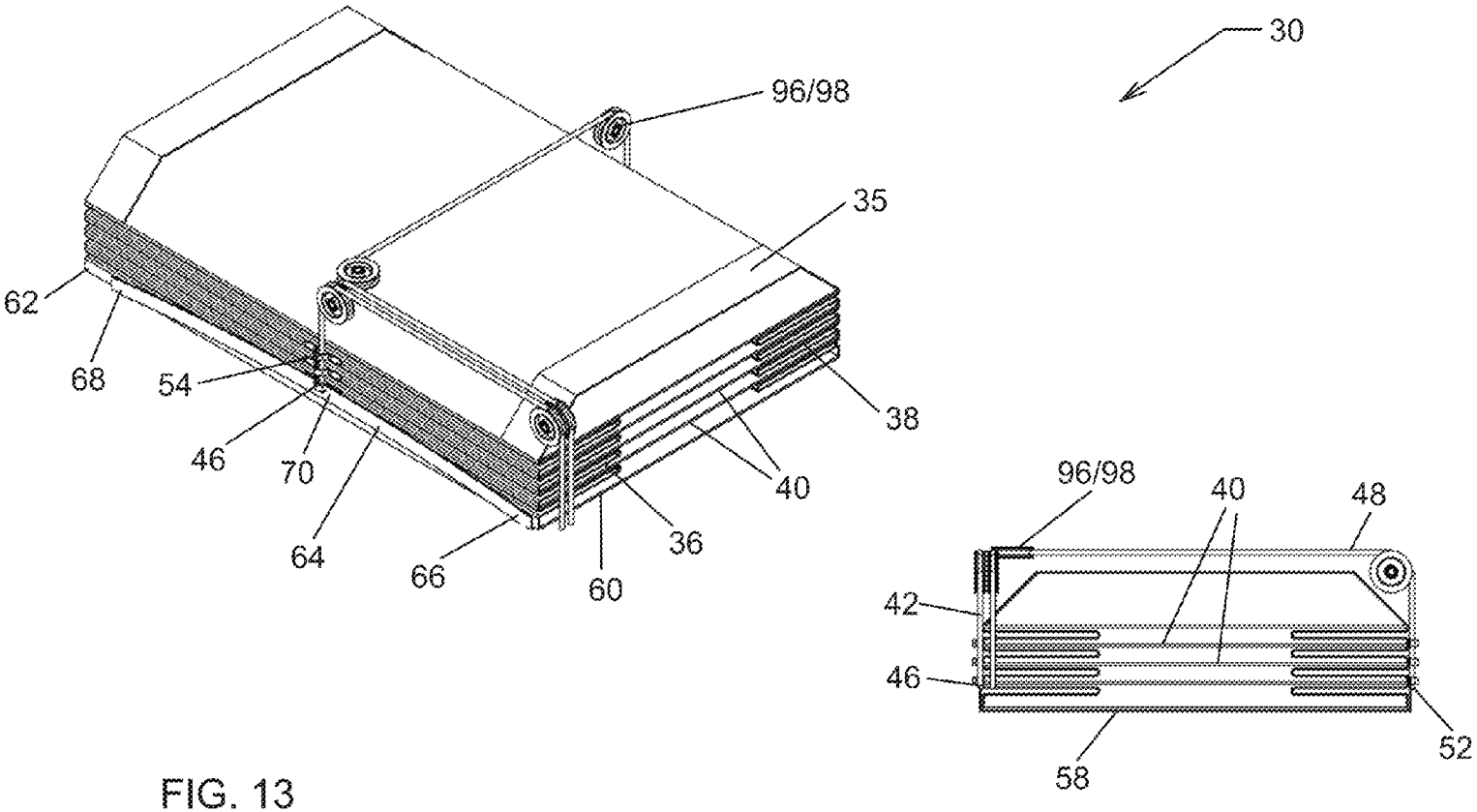
FIG. 13 is a perspective view of the storage system with retractable cells of FIG. 2, showing one cell array with the cells fully retracted.
FIG. 14 is a front elevational view of the storage system with retractable cells of FIG. 2, showing one cell array with the cells fully retracted.
Figures 15, 16, 17, 18, 19, 20:
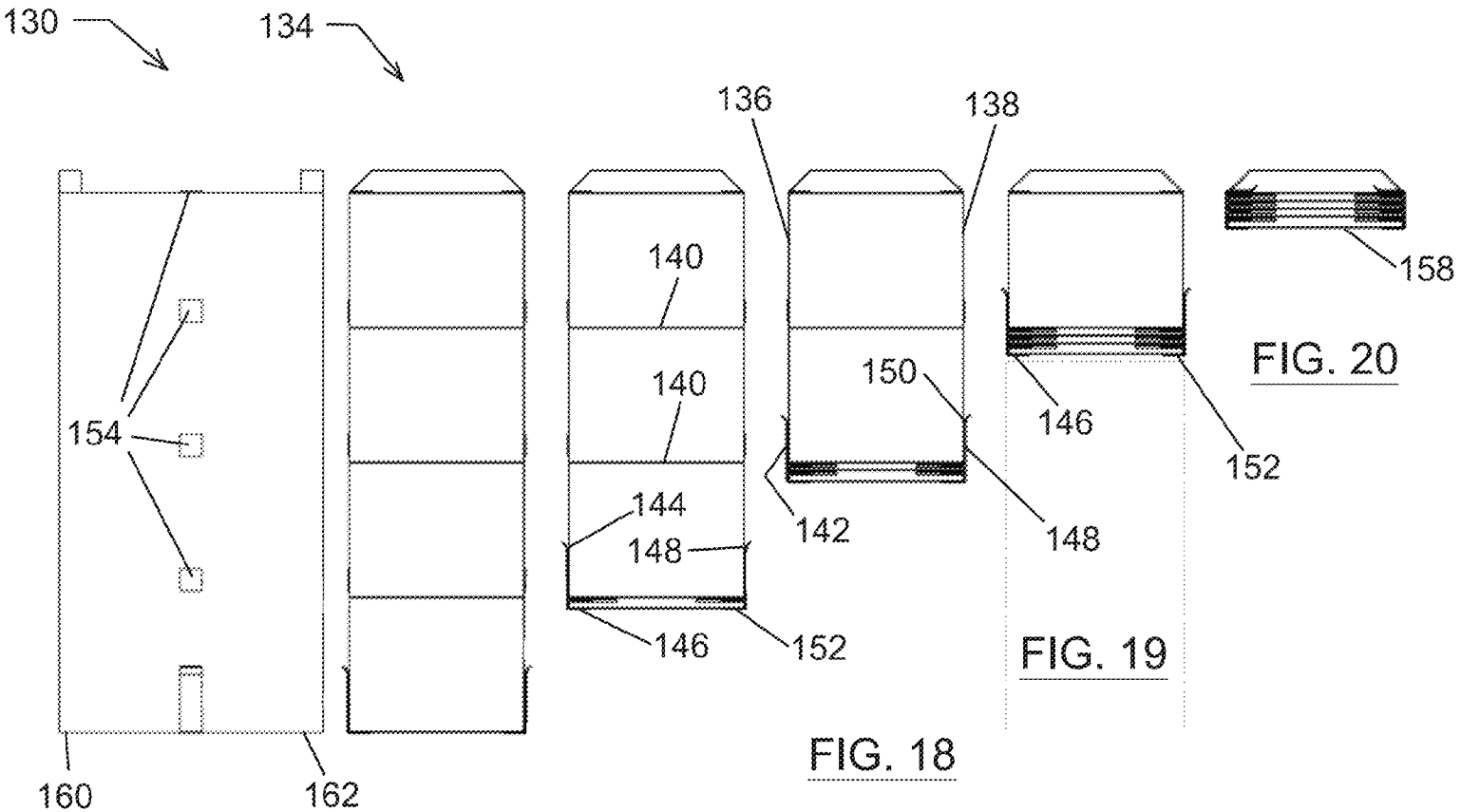
FIG. 15 is a front elevational view of another storage system of the present invention with retractable cells constructed in accordance with the invention.
FIG. 16 is a side elevational view of the storage system with retractable cells of FIG. 15.
FIG. 17 is a front elevational view of the storage system with retractable cells of FIG. 15, showing the lowermost cell retracted.
FIG. 18 is a front elevational view of the storage system with retractable cells of FIG. 15, showing two cells retracted.
FIG. 19 is a front elevational view of the storage system with retractable cells of FIG. 15, showing three cells retracted.
FIG. 20 is a front elevational view of the storage system with retractable cells of FIG. 15, showing all four cells retracted.
Figure 22:
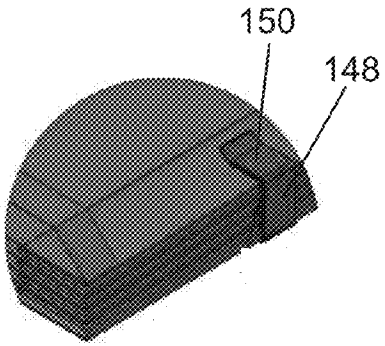
FIG. 22 is an enlarged detail view of the storage system with retractable cells of FIG. 15, taken at Detail 22 in FIG. 21, and showing the filament attaching means.
Figure 21:
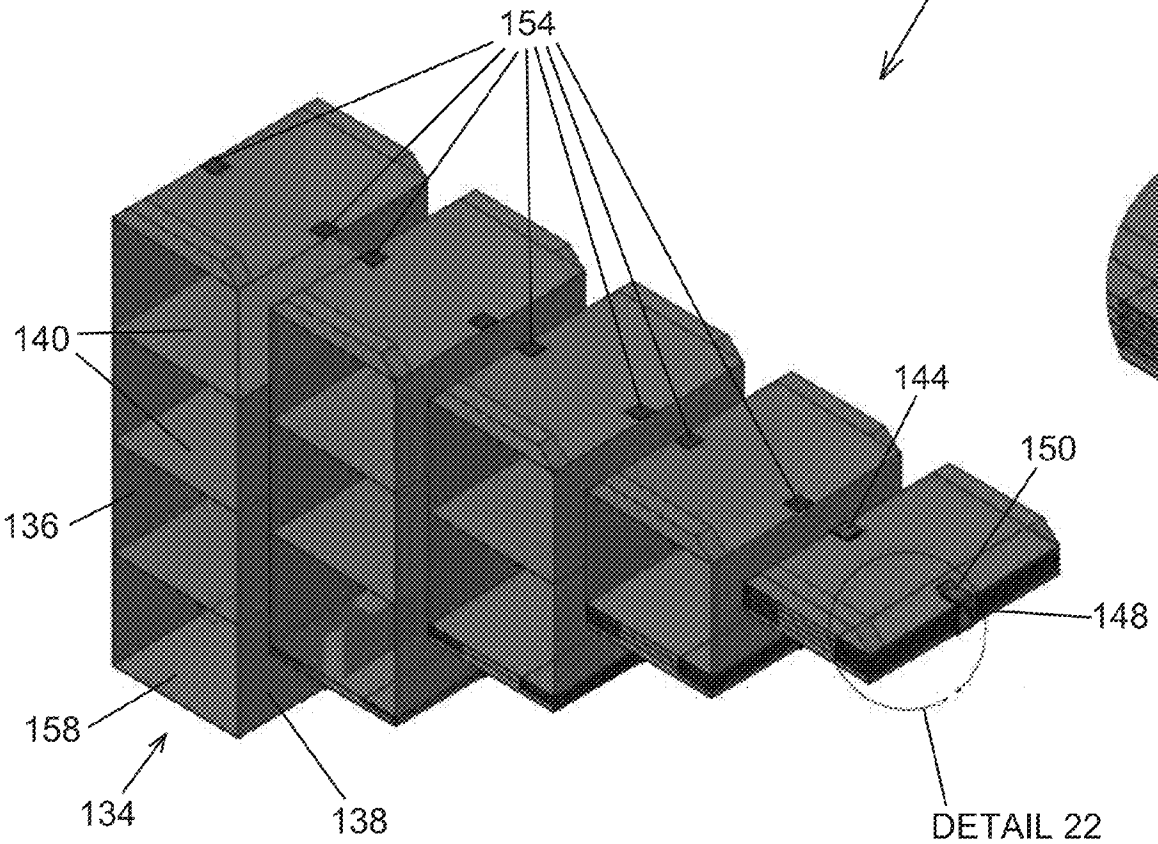
FIG. 21 is a perspective view of FIGS. 15 and 17-20.
Figures 23, 24:
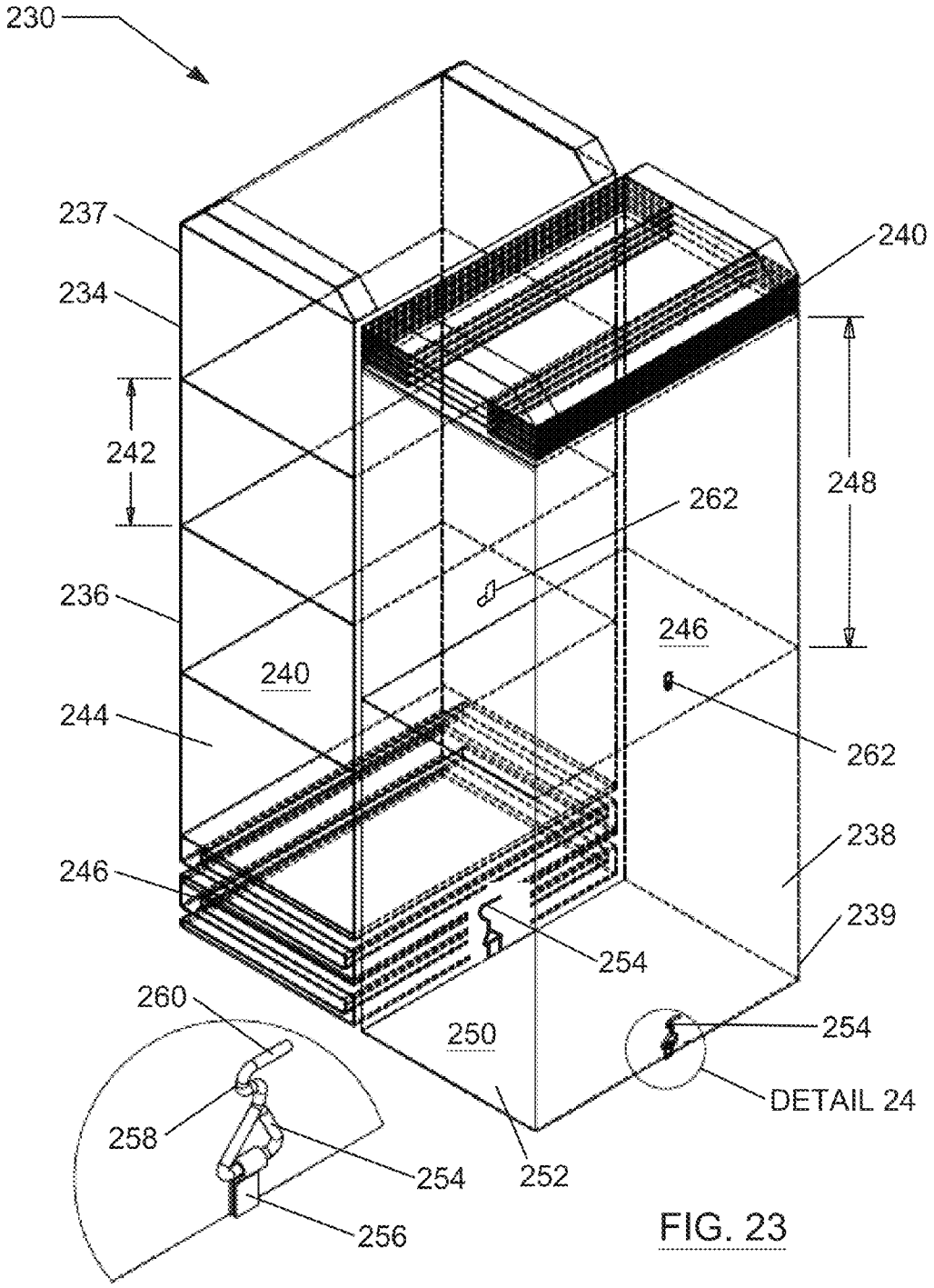
FIG. 23 is a perspective view of yet another storage system of the present invention with retractable cells constructed in accordance with the invention.
FIG. 24 is an enlarged detail view of the storage system with retractable cells of FIG. 23, taken at Detail 24 in FIG. 23, and showing the hanger attaching means.
Figure 25:
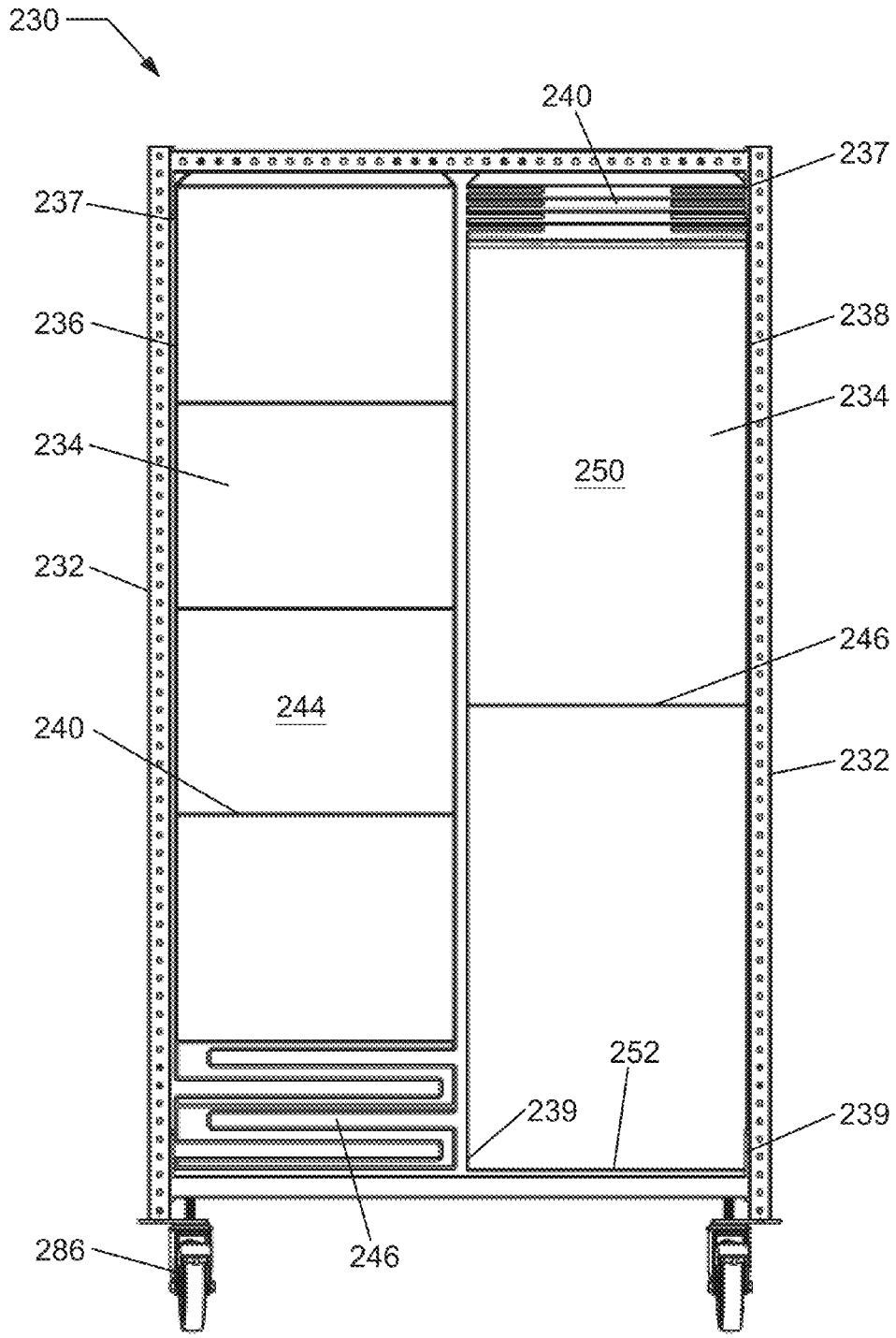
FIG. 25 is a front elevational view of the storage system with retractable cells of FIG. 23, and showing two cells mounted in a mobile support.
Figure 26:
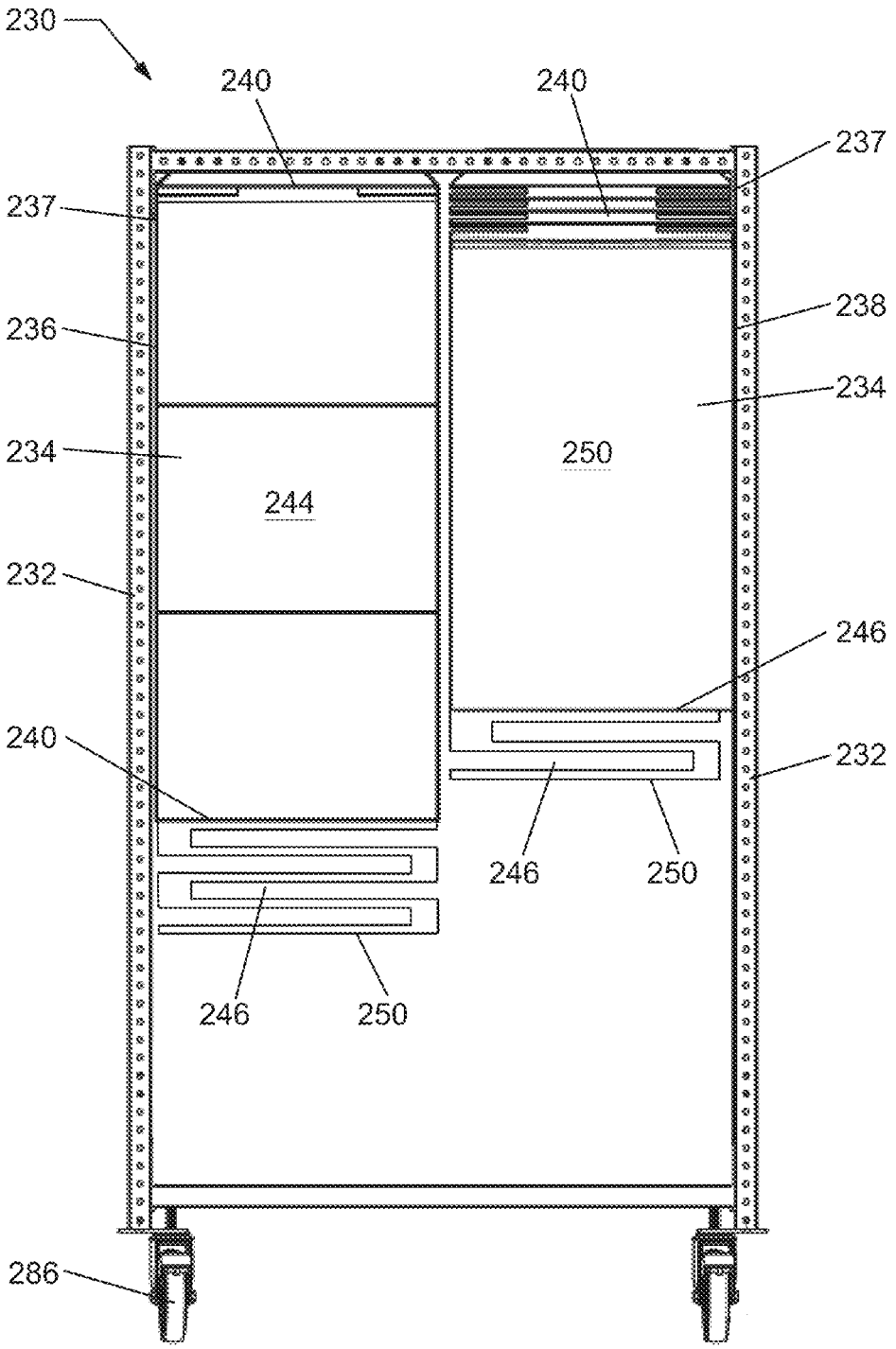
FIG. 26 is a front elevational view of the storage system with retractable cells of FIG. 23, and showing the two cells partly retracted.
Figure 27:
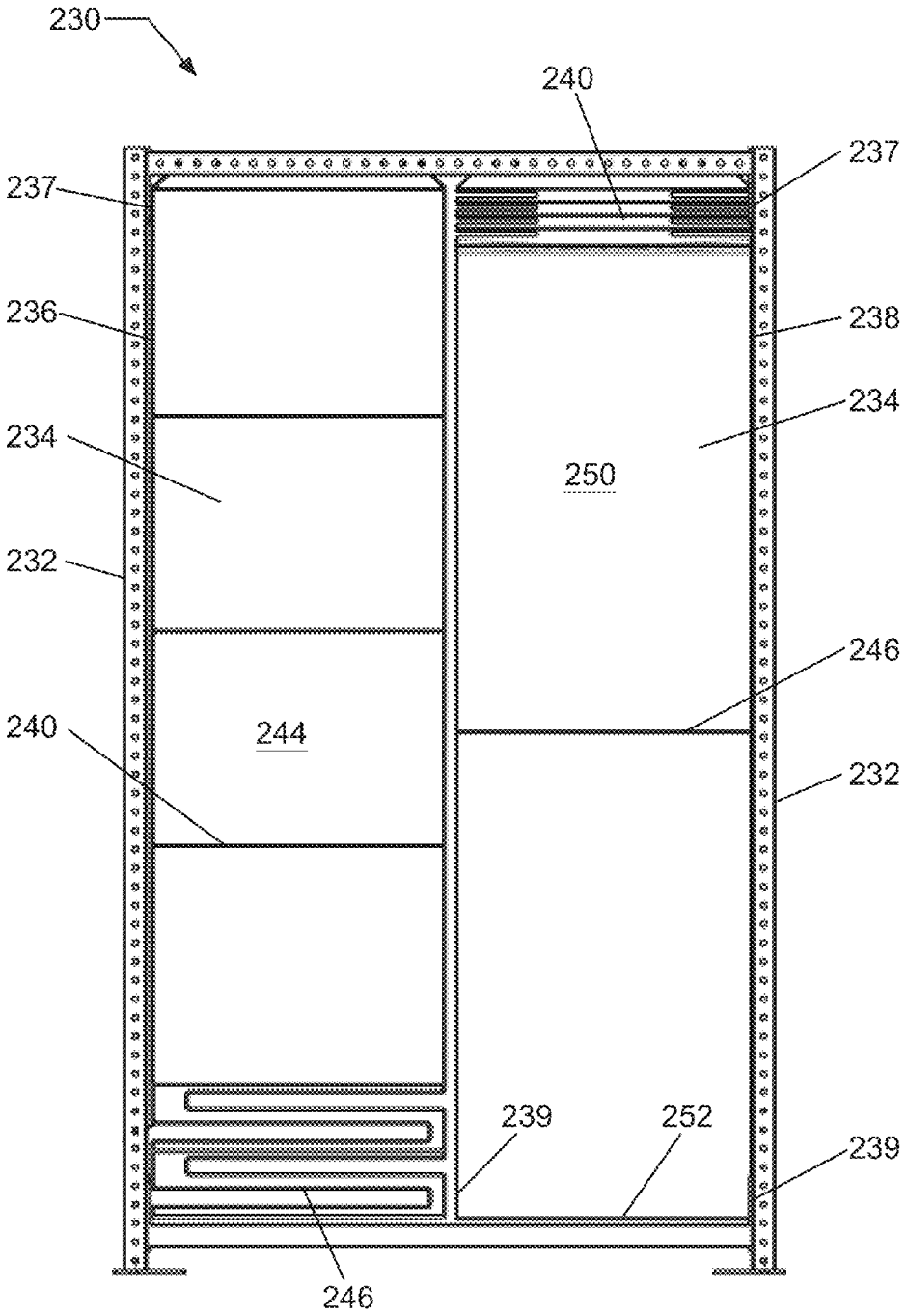
FIG. 27 is a front elevational view of the storage system with retractable cells of FIG. 23, and showing two cells mounted in a fixed support.

The predetermined space is defined by the shelves 40 being spaced apart vertically. The predetermined space is typically sufficient to receive a tote (not shown), which is a tray used to store and transport articles in commerce. In practice, pulling the left filament 42 and right filament 48 upward will raise the shelves 40 upward. The shelves 40 may also be lowered downward. The left 36 and right 38 vertical panels will fold inwardly between the shelves 40 in the manner of an accordion bellows, thereby allowing the shelves 40 to be raised and lowered. Thus, the space beneath the shelves will increase, thereby allowing an article larger than a tote to fit beneath the shelves. The shelves 40 can be raised selectively by one cell, two cells, or any number of cells. The shelves 40 can be raised fully, as shown in FIGS. 13 and 14.

Turning now to FIGS. 15-22, another storage system 130 with retractable cells for storing and transporting articles is for use in connection with a structural support. Storage system 130 is similar to storage system 30 described above, in that the storage system 130 comprises a cell array 134 defined as a single hanging column of cells. Left 136 and right 138 flexible vertical panels are adapted for depending from the structural support 132. The structural support (not shown) may be the same as structural support 32 described above, and can be either fixed or mobile. A plurality of shelves 140 extends transversely between the left 136 and right 138 vertical panels. The plurality of shelves 140 includes a lowermost shelf 158. The shelves 140 are generally rigid. The shelves 140 are spaced apart vertically by a predetermined space.

The cell array 134 is raised, lowered, and secured by hangers. The hangers include left 142 and right 148 filaments. The left filament 142 has a proximal end 144 a distal end 146. The right filament 148 has a proximal end 150 and a distal end 152. Each filament 142, 148 is attached at the distal end to the lowermost shelf 158. Storage system 130 differs from storage system 30 described above, in that the filaments 142, 148 extend upward to the proximal end, which is adapted for attachment to any one of the plurality of shelves 140 above the lowermost shelf 158. Attachment means is provided for attaching the left 142 and right 148 filaments to any one of the plurality of shelves 140. The attachment means 154 can take a variety of forms, for example: hook and loop fasteners; hooks and grommets; turn buttons; and snaps. The hook and loop fasteners, known as Velcro®, is preferred.

In practice, the lowermost shelf 158 will be lifted manually upward. This will selectively raise one or more of the plurality of shelves 140 upward. The left 142 and right 148 filaments will be attached to any one of the plurality of shelves 140 above the lowermost shelf 158 with the Velcro® attachment means 154. In this manner, space beneath the plurality of shelves 140 is increased so as to receive, below the lowermost shelf 158, an article larger than the predetermined space. Thus, articles that are too large to fit into a tote can be stored beneath the cell array on the structural support 32.

Referring now to FIGS. 24-27, yet another storage system with retractable cells for storing and transporting articles is shown at 230. Storage system 230 is similar to storage system 30 described above, in that the storage system 230 comprises a structural support 232. The structural support 232 may be a mobile support having wheels and being movable. Alternatively, the structural support 232 may be a fixed support being stationary. Storage system 230 includes at least one linear cell array 234 having a plurality of cells. However this is non-limiting, and any number of cell arrays can be utilized. Each cell array 234 includes right 238 and left 236 opposed flexible vertical panels. Each panel 236, 238 is attached at an upper end 237 to the structural support 232. Each panel 236, 238 extends downward to a lower end 239.

Storage system 230 differs from storage system 30 described above, in that the storage system 230 includes a first plurality of shelves 240 extending transversely between the right 238 and left 236 vertical panels. The first plurality of shelves 240 is spaced apart vertically by a first predetermined space 242 and has a first size cell 244.

A second plurality of shelves 246 extends transversely between the right 238 and left 236 vertical panels. The second plurality of shelves 246 is spaced apart vertically by a second predetermined space 248 and having a second size cell 250. The second predetermined space 248 is greater than the first predetermined space 242. The second size cell 250 is larger than the first size cell 244. Either one of the first or second plurality of shelves is disposed above the other plurality of shelves. The first plurality of shelves 240, having the first size cell 244, may be disposed uppermost in the cell array. The second plurality of shelves 246, having the second size cell 250, is then disposed lowermost in the cell array. This arrangement is shown in the drawings. Alternatively, The second plurality of shelves 246, having the second size cell 250, may be disposed uppermost in the cell array. The first plurality of shelves 240, having the first size cell 244, is then disposed lowermost in the cell array (not shown). In either case, the cell array 234 has a lowermost shelf 252 at the bottom.

Right and left hangers 254 are each attached at a distal end 256 to the respective right 238 and left 236 panel lower end 239. The right and left hangers 254 are typically wireformed clips, but can be made of any material, non-limitingly. Each clip 254 is preferably attached at the distal end 256 to the lowermost shelf 252 of the plurality of shelves 240, 246. Each clip 254 extends upward to a proximal end 258 having a hook 260.

Right and left engaging members 262 are attached to the right 238 and left 236 panels adjacent each of the plurality of shelves 240, 246. The right and left engaging members 262 engage the right and left hangers 254 respectively. The engaging members 262 selectively attach the hangers 254 to the panels 238,236 adjacent a selected shelf. The engaging members 262 further comprise loops 262 attached to the right 238 and left 236 vertical panels. The loops 262 may be webbing folded back on itself and sewn or attached to the panels. The loops 262 are juxtaposed with the shelves, on either side of each shelf. The loops 262 receive the clip hooks 260.

The first plurality of shelves is adapted to be selectively raised upward into a raised position, and lowered downward into a lowered position. In this manner, the first size cell may be selected or deselected, as desired. The second plurality of shelves is adapted to be selectively raised upward into a raised position, and lowered downward into a lowered position. In a similar manner, the second size cell may be selected or deselected, as desired. Receiving the clip hooks in the loops will selectively secure the shelves in the raised position.

The first and second plurality of shelves is adapted to be raised sufficiently so as to receive beneath the shelves an article larger than the second size cell. The right and left vertical panels are adapted to fold inward between adjacent shelves, thereby allowing the shelves to be raised upward or lowered downward.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A storage system with retractable cells, for storing and transporting articles, the storage system comprising:

a structural support; and at least one cell array, each cell array including:

right and left opposed flexible vertical panels, each panel being attached at an upper end to the structural support and depending from the structural support, each panel extending downward to a lower end;

a plurality of shelves extending transversely between the right and left vertical panels, the shelves being spaced apart vertically by a predetermined space;

left and right hangers, each hanger being attached at a distal end to the respective left and right panel lower end;

at least one right and one left engaging member attached to the right and left panels respectively, adjacent at least one of the plurality of shelves, and adapted for engaging the right and left hangers, respectively, so as to guide or attach the hangers to the panels; wherein the plurality of shelves is adapted to be raised upward into a raised position, for increasing space beneath the shelves, so as to receive an article beneath the shelves larger than the predetermined space;

the plurality of shelves is adapted to be lowered downward; and the right and left vertical panels are adapted to fold inward between adjacent shelves, thereby allowing the shelves to be raised and lowered; and securing means for securing the shelves in the raised position with the hangers, wherein:

the right and left hangers further comprise right and left filaments respectively, each filament extending from a proximal end at the structural support to a distal end attached to one of the plurality of shelves;

the at least one right engaging member further comprises a plurality of right guide members attached to the right vertical panel, each right guide member being juxtaposed with a one of the plurality of shelves, each right guide member slidingly engaging the right filament;

the at least one left engaging member further comprises a plurality of left guide members attached to the left vertical panel, each left guide member being juxtaposed with a one of the plurality of shelves, each left guide member slidingly engaging the left filament;

the structural support includes upright columns extending between opposite upper and lower ends;

the left filament proximal end extends over an arcuate turning member at the upper end of the structural support;

the right filament proximal end extends over an arcuate turning member at the upper end of the structural support; and the securing means further comprises at least one cleat attached to the structural support for securing the filament proximal ends.

2. The storage system with retractable cells of claim 1, wherein the left and right guide members further comprise webbing attached to the left and right vertical panels, respectively.

3. The storage system with retractable cells of claim 1, wherein:

the plurality of shelves includes a lowermost shelf having a front edge and a rear edge; and the cell array further comprises left and right slings attached to the lowermost shelf and extending from adjacent the front edge to adjacent the rear edge, so as to stabilize the shelf, the filament distal ends being attached to the slings.

4. A storage system with retractable cells, for storing and transporting articles, the storage system comprising:

a structural support; and a cell array including:

a left flexible vertical panel depending from the structural support;

a right flexible vertical panel depending from the structural support, the right vertical panel being generally parallel to the left vertical panel and spaced apart therefrom;

a plurality of shelves extending transversely between the left vertical panel and the right vertical panel, the shelves being generally rigid, the shelves being spaced apart vertically by a predetermined space;

a left filament extending from a proximal end at the structural support to a distal end attached to a one of the plurality of shelves;

a right filament extending from a proximal end at the structural support to a distal end attached to a one of the plurality of shelves;

a plurality of left guide members attached to the left vertical panel, each left guide member being juxtaposed with a one of the plurality of shelves, each left guide member slidingly engaging the left filament;

a plurality of right guide members attached to the right vertical panel, each right guide member being juxtaposed with a one of the plurality of shelves, each right guide member slidingly engaging the right filament;

pulling means for pulling the left filament and right filament upward, so as to raise the plurality of shelves upward; and securing means for securing the shelves in the raised position with the filaments;

wherein the left vertical panel and the right vertical panel will fold inwardly between the shelves in the manner of an accordion bellows, thereby increasing space beneath the shelves, so as to receive beneath the shelves an article larger than the predetermined space.

5. The storage system with retractable cells of claim 4, wherein the cell array further comprises:

the plurality of shelves includes a lowermost shelf having a front edge and a rear edge;

a left sling having a front portion attached to the lowermost shelf adjacent the front edge and a rear portion attached to the lowermost shelf adjacent the rear edge, the front and rear portions extending upward from the lowermost shelf and converging at a left sling apex, the left filament distal end being attached to the left sling apex; and a right sling having a front portion attached to the lowermost shelf adjacent the front edge and a rear portion attached to the lowermost shelf adjacent the rear edge, the front and rear portions extending upward from the lowermost shelf and converging at a right sling apex, the right filament distal end being attached to the right sling apex; wherein the front and rear portions of the left and right slings, being spaced apart, will stabilize the lowermost shelf against tipping.

6. The storage system with retractable cells of claim 4, wherein:

the structural support includes upright columns extending between opposite upper and lower ends; and the pulling means further comprises:

the left filament proximal end extending over an arcuate turning member at the upper end of the structural support; and the right filament proximal end extending over an arcuate turning member at the upper end of the structural support; and the securing means further comprises at least one cleat attached to the structural support for securing the filament proximal ends.

7. The storage system with retractable cells of claim 4, wherein the structural support is selected from the group consisting of:

a mobile support having wheels and being movable; and a fixed support being stationary.

8. The storage system with retractable cells of claim 6, wherein the arcuate turning member is selected from the group consisting of:

a pulley; and a winch adapted for motor driving.

9. The storage system with retractable cells of claim 4, wherein the predetermined space is sufficient to receive a tote.

10. The storage system with retractable cells of claim 4, wherein the left and right guide members further comprise webbing attached to the left and right vertical panels, respectively.

11. A method for retracting cells, in a storage system for storing and transporting articles, the method comprising:

providing a structural support including upright columns extending between opposite upper and lower ends;

depending left and right flexible vertical panels from the structural support and spacing the vertical panels apart;

extending a plurality of shelves transversely between the vertical panels;

spacing the shelves apart vertically by a predetermined space sufficient to receive a one of the articles;

attaching left and right hangers at distal ends to a one of said plurality of shelves, wherein the right and left hangers further comprise right and left filaments respectively, extending each filament from a proximal end at the structural support to a distal end and attaching to one of the plurality of shelves;

attaching a plurality of left guide members to the left vertical panel, and juxtaposing each left guide member with a one of the plurality of shelves;

slidingly engaging each left guide member with the left filament;

attaching a plurality of right guide members to the right vertical panel, and juxtaposing each right guide member with a one of the plurality of shelves; and slidingly engaging each right guide member with the right filament;

extending the left filament proximal end over an arcuate turning member at the upper end of the structural support;

extending the right filament proximal end over an arcuate turning member at the upper end of the structural support;

providing a securing means comprising at least one cleat attached to the structural support for securing the filament proximal ends;

pulling the left and right hangers upward;

raising said plurality of shelves upward by pulling the left and right hangers; and increasing space beneath the shelves by raising the shelves upward; thereby allowing an article larger than the predetermined space to be received beneath the shelves.

12. The method of claim 11, further comprising:

attaching left and right slings to a lowermost shelf of said plurality of shelves;

extending the left and right slings from adjacent a front edge of the lowermost shelf to adjacent a rear edge of the lowermost shelf;

attaching the filament distal ends to the slings; and stabilizing the lowermost shelf with the left and right slings.

13. The method of claim 12, further comprising:

spacing the shelves apart vertically by a predetermined space sufficient to receive a tote; and folding the left vertical panel and the right vertical panel inwardly between the shelves while raising the plurality of shelves upward; thereby increasing space beneath the shelves, so as to receive an article larger than the tote.

14. The method of claim 11, wherein the structural support is selected from the group consisting of:

a mobile support having wheels and being movable; and a fixed support being stationary.

15. The method of claim 11, wherein the arcuate turning member is selected from the group consisting of:

a pulley; and a winch adapted for motor driving.

* * * * *